US005820818A

United States Patent [19]

Kajimura

[11] Patent Number: 5,820,818

[45] Date of Patent: Oct. 13, 1998

[54] STAINLESS STEEL HAVING EXCELLENT THERMAL NEUTRON ABSORPTION ABILITY

[75] Inventor: Haruhiko Kajimura, Kobe, Japan

[73] Assignee: Sumitomo Metal Industries, Ltd., Osaka, Japan

[21] Appl. No.: 984,689

[22] Filed: Dec. 3, 1997

Related U.S. Application Data

[63] Continuation of PCT/JP96/02258 Aug. 8, 1996 published as WO97/06286 Feb. 20, 1997.

[51] Int. Cl. [6] ..... C22C 38/32; C22C 38/54

[52] U.S. Cl. ..... 420/40; 420/43; 148/325; 148/327

[58] Field of Search ..... 420/40, 43; 148/325, 148/327

[56] References Cited

FOREIGN PATENT DOCUMENTS

| | | |
|---|---|---|
| 55-89459 | 7/1980 | Japan . |
| 62-56557 | 3/1987 | Japan . |
| 5-255812 | 10/1993 | Japan . |
| 6-192792 | 7/1994 | Japan . |

*Primary Examiner*—Deborah Yee
*Attorney, Agent, or Firm*—Burns, Doane, Swecker & Mathis, LLP

[57] ABSTRACT

The ferritic stainless steel of the present invention contain the following main chemical elements, in which a relationship between B and Gd, preferably, satisfies the following equation (1) on the weight % basis:

| | |
|---|---|
| C: less than 0.01% | Mn: not more than 1% |
| Ni: not more than 0.7% | Cr: 13–26% |
| B: 0.1–1.1% | Gd: 0.05–1.5% |
| Al: 0.002–0.1% | N: not more than 0.015%. |

The austenitic stainless steel of the present invention contain the following main chemical elements, in which a relationship between B and Gd, preferably, satisfies the following equation (1) on the weight % basis:

| | |
|---|---|
| C: not more than 0.02% | Mn: 0.1–0.9% |
| Ni: 7–22% | Cr: 18–26% |
| B: 0.05–0.75% | Gd: 0.11–1.5% |
| Al: 0.005–0.1% | N: not more than 0.03%. |

The stainless steel of the present invention described above are excellent in thermal neutron absorption ability, as well as are excellent in the workability such as hot workability and cold workability, and the corrosion resistance, particularly, the corrosion resistance for HAZ and are inexpensive for the manufacturing cost.

20 Claims, No Drawings

STAINLESS STEEL HAVING EXCELLENT THERMAL NEUTRON ABSORPTION ABILITY

CROSS REFERENCE TO RELATED APPLICATIONS

This application is a continuation-in-part of International PCT Application No. PCT/JP96/02258, which designates the United States of America filed Aug. 8, 1996, now WO 97/06286 dated Feb. 20, 1997.

TECHNICAL FIELD

The present invention concerns ferritic and austenitic stainless steels of excellent thermal neutral absorption ability used as components for nuclear fuel transportation casks, spent nuclear fuel storage casks or racks in nuclear industries.

BACKGROUND ART

Thermal neutrons are generated from nuclear materials contained, for example, in nuclear fuel transportation casks, spent nuclear fuel storage casks or racks. For preventing thermal neutrons from leaking externally, it is demanded for the materials used for such components to have excellent thermal neutron absorption ability. Furthermore, for preventing such casks from undergoing damages by corrosion, it is demanded for base metals of the materials and weld zones of the materials by welding that they have excellent corrosion resistance.

Therefore, stainless steel such as JIS SUS 304 series austenitic stainless steel of excellent corrosion resistance added with about 1 wt % of B (boron) have been usually used for the components described above. This is because B has a large absorption cross section of thermal neutrons and, therefore, thermal absorption ability of the stainless steel can be improved by the addition of B.

In recent years, reliance on nuclear power generation has been increased in view of electric power demand and, the amount of nuclear fuel elements handled before and after use has been increased correspondingly. It has been strongly demanded for stainless steel having sufficient thermal neutron absorption ability and sufficient corrosion resistance in view of safety for application uses such as transportation or storage racks for nuclear fuels, as well as structural materials related to nuclear power generation.

The thermal neutron absorption ability of a material is increased in proportion with the content of elements having large neutron absorption cross section. Accordingly, the thermal neutron absorption ability of the material is greater as the B content is higher. However, B-containing austenitic stainless steel involve a drawback that hot workability, cold workability and toughness are deteriorated with the increase in the B content. For instance, since the hot workability is poor, cracking often occurs to rolled materials upon hot rolling for manufacturing hot rolled steel sheets. Such a problem also occurs similarly in a case of containing B in ferritic stainless steel.

The reason why the hot workability or cold workability of the B-containing stainless steel is poor may be considered as below. When B is added to the stainless steel, a boride, $(Cr,Fe)_2B$, is generated. Since the boride has a melting point as low as 1200° C., it deteriorates the hot workability. Furthermore, since it is brittle at a normal temperature, this causes reduction of the cold workability and toughness. That is, upon hot working or cold working, cracks are generated from borides as initiation points.

In addition to the problem of the hot workability, cold workability and toughness described above, the B-containing stainless steel also involves a problem of weldability. In a case of using stainless steel as structural materials, a weld-joining method has often been employed as a joining method. However, since the B content in conventional B added stainless steel is as high as about 1 wt %, cracks are generated at the welded zones. Particularly, cracks at solidification are remarkable in molten portion, making it sometimes difficult to manufacture like as casks.

As described above, since addition of B to the stainless steel accompanies the drawback, there is a limit for the addition amount. In order to avoid such a drawback, it has been proposed a countermeasure of using Gd (gadolinium) having a greater neutron absorption cross section compared with B.

Naturally existent Gd is a mixture of isotopes containing about 16 wt % of $^{157}Gd$ having an extremely large neutron absorption cross section, and absorption cross section is 49,000 b. Natural B contains about 20 wt % of $^{10}B$ having a large neutron absorption cross section and the balance comprises $^{11}B$ of a small neutral absorption cross section, and the neutron absorption cross section of the natural B is 760 b.

As described above, Gd has a neutron absorption ability about 4.4 times as great as that of B of an identical weight. Accordingly, for providing the same extent of the thermal neutron absorption ability upon addition to the stainless steel, it has been expected that the addition amount can be reduced and the effect on the workability and the corrosion resistance is also smaller in the case of Gd.

For instance, Japanese Patent Laid-Open 62-56557 discloses ferritic and austenitic stainless steel containing 0.1 to 3.0 wt % of Gd instead of B. Furthermore, Japanese Patent Laid-Open 5-255812 discloses austenitic stainless steel incorporated with 0.2 to 1.0 wt % of B and 0.1 to 2.0 wt % of Gd and Japanese Patent Laid-Open 6-192792 discloses austenitic stainless steel incorporated with up to 3.0 wt % of B and from 0.05 to 1.0 wt % of Gd.

Among the conventional stainless steel described above, since Gd containing stainless steel shown in Japanese Patent Laid-Open 62-56557 contain no B, it is considered that lowering of the hot workability and the cold workability can be avoided. However, if the Gd content is excessively high, there also exists a problem that the hot workability is deteriorated. Furthermore, since Gd is an expensive alloying element, there is also an economical problem in a case of providing stainless steel with a high neutron absorption ability. In addition, while the literature described above shows ferritic stainless steel containing not more than 6 wt % of Ni, if Ni is contained by several %, the hot workability is deteriorated due to the incorporation of Ni.

Since austenitic stainless steel disclosed in Japanese Patent Laid-Open 5-255812 and Japanese Patent Laid-Open 6-192792 have high B-content as shown in examples except for several of them, that is, more than 0.7 wt % in the former and not less than 0.5 wt % in the latter, the hot workability, cold workability and weldability can not be considered sufficient. Accordingly, cracks may sometimes occur if intensive working is applied or weld-cracks may be caused to welded zone.

Furthermore, it has been found that each of the austenitic stainless steel shown in the above references is poor in the corrosion resistance in the heat affected zone (HAZ) of the welded zone. As described above, it has been demanded to provide the stainless steel having thermal neutron absorption ability with excellent corrosion resistance both for the base metal and the welded zone. Conventional stainless steel could neither satisfy the corrosion resistance for HAZ.

As described above, conventional stainless steel containing Gd alone or both of B and Gd for improving the thermal neutral absorption ability can not satisfy all the properties of the hot workability, cold workability, toughness and weldability, and the corrosion resistance including HAZ.

The present invention has been accomplished in order to solve the foregoing subject and it is an object to provide ferritic and austenitic stainless steel which are excellent in the thermal neutron absorption ability, as well as excellent in the hot workability, cold workability, toughness, weldability and corrosion resistance of a base metal including HAZ, and which are suitable to the use, for example, in nuclear fuel casks.

DISCLOSURE OF THE INVENTION

The present invention concerns ferritic and austenitic stainless steel which are excellent in the thermal neutron absorption ability, as well as excellent in the hot workability, cold workability, toughness, weldability and corrosion resistance of a base metal including HAZ, inexpensive in the manufacturing cost and suitable to the use, for example, in nuclear fuel casks.

The ferritic stainless steel, according to the present invention, comprises the following chemical composition, in which a relationship between B and Gd preferably satisfies the following equation (1) on the weight % basis:

| | |
|---|---|
| C: less than 0.01% | Si: not more than 0.5% |
| Mn: not more than 1% | P: not more than 0.03% |
| S: not more than 0.01% | Ni: not more than 0.7% |
| Cr: 13–26% | B: 0.1–1.1% |
| Gd: 0.05–1.5% | Al: 0.002–0.1% |
| N: not more than 0.015% | Ti: not more than 1% |
| Nb: not more than 1% | Y: not more than 0.3% |
| Mo: not more than 3% | |
| Balance: incidental impurities and Fe. | |

$$Nc \geqq 0.8 \quad (1)$$

in which $$Nc=\{(1-0.015\times B\ \%)\times B\ \%\}+(4.4\times Gd\ \%)$$

In the ferritic stainless steel described above, if the C content is not more than 0.005% and N content is not more than 0.008%, the corrosion resistance, particularly, the corrosion resistance for HAZ is further improved. Furthermore, the Ni addition by from 0.05 to 0.7%, can further improve the toughness.

The austenitic stainless steel according to the present invention comprises the following chemical composition, in which a relationship between B and Gd preferably satisfies the following equation (1) on the weight % basis:

| | |
|---|---|
| C: not more than 0.02% | Si: not more than 1% |
| Mn: 0.1–0.9% | P: not more than 0.03% |
| S: not more than 0.01% | Ni: 7–22% |
| Cr: 18–26% | B: 0.05–0.75% |
| Gd: 0.11–1.5% | Al: 0.005–0.1% |
| N: not more than 0.03% | Y: not more than 0.3 |
| Mo: not more than 3% | |
| Balance: incidental impurities and Fe. | |

In the austenitic stainless steel described above, if the B content is from 0.2 to 0.5%, the hot workability, cold workability and weldability can be further improved.

In the ferritic and austenitic stainless steel of the present invention, the B content is kept lower, but the B content should be selected as high as possible, within the restricted range, to supplement the insufficiency of the thermal neutron absorption ability with Gd. Furthermore, the C content and the N content are kept lower in the ferritic stainless steel, while the Mn content is kept to be lower in the austenitic stainless steel. Accordingly, they are excellent in the workability such as hot workability and cold workability, and the corrosion resistance, particularly, the corrosion resistance for HAZ, in addition to the thermal neutron absorption ability. Furthermore, since they are satisfactory in the toughness and weldability and are inexpensive in manufacturing cost, they are highly suitable to materials for nuclear fuel casks.

BEST MODE FOR CARRYING OUT THE INVENTION

As described above, since Gd has a larger neutron absorption cross section compared with B, it is an element effective to enhance the neutron absorption ability of stainless steel. However, as a result of investigation for the effect of Gd addition on the properties of Ni containing austenitic stainless steel, it has been found that cracks occur remarkably in forged materials along with increase in the Gd content upon hot working such as forging. Gd-added austenitic stainless steel tend to be cracked when heated at high temperature and cause cracks even at a low heating temperature if the content is high. This trend is also observed in the ferritic stainless steel containing small amount of Ni.

As a result of investigating the reason, it has been confirmed the presence of a low temperature eutectic phase in which Ni and Gd are concentrated between dendrite arms of a dendrite structure of the forged material. It has been considered that the eutectic phase having low melting temperature melts when heated to the working temperature and causes initial points of cracking by working. As described above, since Gd is an element of worsening the hot workability, it is preferred that the content is lower. Furthermore, since it is also extremely expensive as the alloying material, the content is desirably lower also from an economical view point.

In the stainless steel of the present invention, the fundamental idea of ensuring the neutron absorption ability and ensuring the aimed performances such as hot workability, corrosion resistance and weldability are as below:

(A) To improve the thermal neutron absorption ability by the addition of B as much as possible within such a range so as not to deteriorate the hot workability, cold workability, weldability and corrosion resistance.

(B) To compensate the neutron absorption ability which is not attainable sufficiently only with B, by the combined use of Gd. However, Gd content is kept as low as possible by the countermeasure (A).

(C) To improve the corrosion resistance, particularly, the corrosion resistance for HAZ by keeping the Mn content lower in the austenitic stainless steel and restricting the C content and the N content lower in the ferritic stainless steel.

The contents of B and Gd in the stainless steel of the present invention are determined by the following sequence.

(a) To determine the upper limit value, Bu, for the B content within such a range as not deteriorating the hot workability in the ferritic steel and mainly weldability in the austenitic steel.

(b) To determine the B content BNc based on the thermal neutron absorption ability Nc required for each of the stainless steel and the lower limit value for the Gd content specified for the stainless steel of the present invention by the following formula (2):

(c) To calculate the Gd content by substituting Bu into B of the formula (2) when: BNc>Bu.

$$Nc=\{(1-0.015\times B\ \%)\times B\ \%\}+(4.4\times Gd\ \%) \quad (2)$$

in which the equation (2) shows the thermal neutron absorption ability Nc of stainless steel containing both B and Gd on the B equivalent. In this equation, it is taken into consideration that B compounds (borides) are formed in a case of adding B, to lower the density of the stainless steel. Furthermore, if the B content is not more than 0.3%, following equation (3) may also be used $$Nc=B\ \%+(4.4\times Gd\ \%) \quad (3)$$

In the stainless steel of the present invention, B and Gd contents are determined based on the concept described above. Accordingly, it is possible to obtain stainless steel having required neutron absorption ability, as well as excellent in the hot workability, cold workability, toughness, weldability and corrosion resistance.

The value of the thermal neutron absorption ability Nc demanded for the stainless steel is determined depending on the conditions such as application use of the stainless steel. However, since it is often required to contain about 0.6% of natural boron in the stainless steel used at present for the control of nuclear reactors, nuclear fuel storage or the like, it is defined as Nc≧0.8 as described above as preferred condition in the stainless steel according to the present invention.

Then, chemical compositions of the ferritic stainless steel and austenitic stainless steel in the present invention will be explained in detail. In the following descriptions, % expression for the content of each of the elements is on the weight % basis.

(Ferritic Stainless Steel)

C: For obtaining the corrosion resistance comparable with that of the austenitic stainless steel, the C content together with the N content is kept as low as possible in the ferritic stainless steel of the present invention. The strength of the stainless steel is somewhat lowered by lowering the C content. However, this can provide not only the effect of improving the corrosion resistance but also in the improving the hot workability and the cold workability and, furthermore, improving the weldability, so that it is essential to lower the C content in the ferritic stainless steel of the present invention. Therefore, in the present invention, C is defined as less than 0.01%. It is preferably not more than 0.005%.

Si: Si is an element added for deoxidation of molten steel. However, in the ferritic stainless steel of the present invention, since Al having the deoxidation effect is added, Si may not be added. In the ferritic stainless steel of the present invention, Si scarcely affects on various properties required for the stainless steel. In a case of adding Si, it is necessary to keep the content to not more than 0.5%. This is because eutectic having low melting temperature is formed between Si and Gd to worsen the hot workability if the Si content exceeds 0.5%.

Mn: Mn may not be added. It may be added in order to obtain effects such as improvement in the deoxidation of molten steel and the hot workability, in which the upper limit is preferably set to not more than 1%. This is because the corrosion resistance of the stainless steel is lowered if the content exceeds 1%.

Cr: Cr is an element essential to ensure the corrosion resistance required for ferritic stainless steel. If the Cr content is less than 13%, since no stable corrosion resistant layer is formed on the surface of the stainless steel, no sufficient effect for improving the corrosion resistance can be obtained. On the other hand, if the Cr content exceeds 26%, the hot workability is worsened. Accordingly, the Cr content is defined as from 13 to 26%.

B: B has a property of forming borides and deteriorating the hot workability, cold workability and weldability in the ferritic stainless steel. However, it is possibly added in the ferritic stainless steel of the present invention for satisfying the required thermal neutron absorption ability and the upper limit is defined as 1.1%. If the B content is not more than 1.1%, it does not give undesired effects on the properties such as hot workability, cold workability and toughness in the ferritic stainless steel to the present invention.

On the other hand, it has to be contained by not less than 0.1% B in order to provide the ferritic stainless steel with the neutron absorption ability. Accordingly, the B content is defined as from 0.1 to 1.1%.

As described previously, the neutron absorption ability is satisfied by the combined use of B and Gd. In particular, since B is inexpensive in the cost as the alloying material, it is used preferentially to Gd in the stainless steel of the present invention.

Gd: Gd has an effect of improving the neutron absorption ability about 4.4 times as large as that of B of an identical content. Furthermore, in a case of the ferritic stainless steel, it gives less undesired effect, for example, on the hot workability compared with B. Accordingly, it is contained at least by 0.05%. However, since this is an expensive alloying element and deteriorates the hot workability if the content is high, the upper limit is restricted to 1.5%. In this way, in the ferritic stainless steel of the present invention, the Gd content is defined as from 0.05 to 1.5% and a content as low as possible is selected within this range.

The range for the contents of B and Gd are as described above, and the contents of B and Gd are determined within the range. That is, if the neutron absorption ability required for each of the ferritic stainless steel is determined, the contents of B and Gd may be determined in the sequence of (a), (b) and (c) as described above. Assuming the neutron absorption ability Nc as 2, since the lower limit for Gd in the ferritic stainless steel is 0.05%, when the B content is determined by substituting 2 for Nc and 0.05 for Gd in the equation (2), the B content is 1.83% which exceeds upper limit of 1.1%. In this case, by setting the B content to 1.1% or less which is allowable in view of the property and determining the Gd content from the equation (2), the contents of B and Gd can be determined.

If the Gd is added by not less than the lower limit value, it is not always required to set the Gd content to the upper limit value and an appropriate value may be selected while taking allowable range into consideration with a view point of properties such as the weldability and the hot workability and economical reason.

Al: Al is an element added to steel making to obtain sound cast pieces by deoxidation of molten steel. Particularly, since Gd is contained by from 0.05 to 1.5% in the ferritic stainless steel of the present invention, it is important to thoroughly deoxidize the molten steel so as not to form Gd oxides. If Gd oxides are formed, the oxides remain as non-metallic inclusions in the steel and the inclusions may appear on the surface of the stainless steel. In such a case, since corrosion may possibly proceed starting from the exposed non-metallic inclusions, it is necessary to thoroughly deoxidize the molten steel before addition of Gd.

For this purpose, it is necessary to contain Al by not less than 0.002% as an acid soluble Al (sol Al). However, if the content exceeds 0.1%, the effect is saturated and, furthermore, the hot workability is deteriorated. Accordingly, the Al content is defined as from 0.002 to 0.1%.

Y: Y is an optionally added element. Since Y is an element having an effect of improving the hot workability and it is an element having a stronger affinity with oxygen in the molten steel compared with Al, it is effective for preventing oxidation of Gd. If such an effect is necessary, Y is preferably contained by not less than 0.005%. However, if it exceeds 0.5%, the effect is saturated, so that the upper limit is defined as 0.5%.

Ni: Ni is an optionally added element in the ferritic stainless steel of the present invention. The element is added when it is necessary to further improve the toughness of the ferritic stainless steel. If the Ni content is less than 0.05%, no effect of improving the toughness can be obtained. On the other hand, if the content exceeds 0.7%, the hot workability is deteriorated. Accordingly, when Ni is contained, it is preferably from 0.05 to 0.7%. The hot workability is worsened if the Ni content exceeds 0.7%, because eutectic having low melting temperature is formed by the reaction between Ni and Gd.

Mo: Mo is an optionally added element. The element is added when it is required to further improve the resistance to pitting corrosion and corrosion resistance to crevice corrosion in the ferritic stainless steel. In order to obtain these effects, not less than 0.1% of the element is necessary. However, if it exceeds 3%, the hot workability is deteriorated. Accordingly, if Mo is added, the content is preferably from 0.1 to 3%.

Ti and Nb: Ti and Nb are optionally added elements like that Ni and Mo. Such elements are added if it is necessary to improve the corrosion resistance in the heat affected zone (HAZ) of welded portion and the cold workability. In order to obtain this effect, it is necessary for each of Ti and Nb to be contained by not less than 0.005%. If each of the content exceeds 1%, not only the addition effect is saturated but also the hot workability and the cold workability are deteriorated. Accordingly, when such elements are added, each of them is preferably defined as from 0.005 to 1%.

N: The N content is preferably lower like that C in order to provide a sufficient corrosion resistance to the ferritic stainless steel of the present invention. For this purpose, the N content is defined as not more than 0.015%. It is further preferably not more than 0.008%.

P and S: P and S are impurity elements intruding incidentally from raw materials used in steel making steps. Since such elements deteriorate the corrosion resistance and the workability of the ferritic stainless steel, lower content is better. However, since there is a limit for lowering P and S in commercial production, P is defined as not more than 0.03% and S is defined as not more than 0.01% as a range with no practical disadvantage.

(Austenitic Stainless Steel)

C: C is an austenite-forming element and this is an element effective for ensuring the stability and the strength of the austenite phase in the austenitic stainless steel. However, C has an effect of lowering the corrosion resistance for HAZ. In the austenitic stainless steel of the present invention, a more importance is attached to the corrosion resistance for HAZ and the C content is restricted to not more than 0.02%

Si: Si is an element added for deoxidation of molten steel. However, in the austenitic stainless steel of the present invention, since Al having the deoxidation effect is added, Si may not be added. In a case of adding Si, it is required to keep Si to not more than 1%. This is because eutectic having low melting temperature is formed by the reaction between Si and Gd to worsen the hot workability if the Si content exceeds 1%. It is preferably not more than 0.5%.

Mn: Mn is an element having an effect of stabilizing the austenite phase and this is an element effective to control the undesired effects of S of incidental impurities. For obtaining these effects, it is necessary to contain Mn by not less than 0.1%. However, if the Mn content exceeds 0.9%, the corrosion resistance, particularly, the corrosion resistance for HAZ is lowered. Accordingly, the Mn content is defined as from 0.1 to 0.9%.

Ni and Cr: Both of Ni and Cr are elements essential to ensure the metallurgical structure and the corrosion resistance required for the austenitic stainless steel. For this purpose, it is necessary to contain Ni by not less than 7% and Cr by not less than 18%.

On the other hand, if the Ni content exceeds 22%, the manufacturing cost is increased and eutectic having low melting temperature are formed by the reaction between Ni and Gd to deteriorate the hot workability. Furthermore, if the Cr content exceeds 26%, since the Ni content has to be increased in accordance with the increase of the Cr content for austenitizing the stainless steel in accordance with the increase in the Cr content, the manufacturing cost is increased and the hot workability is deteriorated.

Accordingly, the Ni content is defined as from 7 to 22%, while the Cr content is defined as from 18 to 26%.

B: B has a property of forming borides and deteriorating the hot workability, cold workability and weldability in the austenitic stainless steel. However, B is positively added by not less than 0.05%, preferably, not less than 0.2% in the austenitic stainless steel of the present invention for satisfying the thermal neutron absorption ability. As described above, since the undesired effect caused by the addition of B appears most remarkably in the hot workability and the cold workability, the upper limit for the B content is defined as 0.75% with such view points. If the B content is not more than 0.75%, it gives less effect on the properties such as the hot workability, cold workability and weldability in the austenitic stainless steel of the present invention. Furthermore, a preferred upper limit for the B content is 0.5%.

As described previously, the neutron absorption ability is satisfied by the combined use of B and Gd in the austenitic stainless steel of the present invention. In particular, since B is inexpensive in the cost as the alloying material, it is used preferentially to Gd in the stainless steel of the present invention.

Gd: Gd has an effect of improving the neutron absorption ability about 4.4 times as large as that of B of an identical content. Furthermore, Gd has an effect of preventing the deterioration of the weldability caused by the addition of B. That is, in the austenitic stainless steel, the weldability tends to be lowered in a range about from 0.1 to 0.8% with a peak being at about 0.3%, but the deterioration of the weldability can be suppressed if a smaller amount of Gd is contained. In addition, Gd has a feature of giving less undesired effect on the hot workability or the like of the austenitic stainless steel compared with B. Accordingly, it is contained at least by 0.11%.

However, since Gd is an expensive alloying element, it increases the manufacturing cost and high content deteriorates the hot workability, so that the upper limit of the Gd content is defined as 1.5%.

In the austenitic stainless steel of the present invention, the Gd content is defined as from 0.11 to 1.5% and the Gd content is selected as low as possible within these ranges.

The range for the B and Gd contents are as described above, and the B and Gd contents are determined within these ranges. That is, if the neutron absorption ability required for each of the austenitic stainless steel is determined, the B and Gd contents may be determined in the sequence of (a), (b) and (c) as described above. Assuming the neutron absorption ability Nc as 2, since the lower limit for Gd content in the austenitic stainless steel is 0.11%, when the B content is determined by substituting 2 into Nc and 0.11 into Gd in the equation (2), the B content is 1.55% which exceeds the upper limit of 0.75%. In this case, by setting the B content to 0.75 or less allowable in view of the properties and determining the Gd content from the equation (2), the contents of B and Gd can be determined.

If the Gd is added by more than the lower limit value, it is not always required to determine the Gd content to the upper limit value and an appropriate value may be selected while taking allowable range into consideration with a view point of properties such as the weldability and the hot workability and the economical reason. A preferred range for the Gd content is from 0.2 to 1.5%.

Al: Al is an element added in steel making to obtain sound cast pieces by deoxidation of molten steel. Particularly, since the C content is restricted low in the austenitic stainless steel of the present invention, O (oxygen) in the molten steel is increased. Furthermore, since 0.11 to 1.5% of Gd is contained, it is important to thoroughly deoxidize the molten steel so as not to form Gd oxides. If Gd oxides are formed, the oxides remain as non-metallic inclusions in the steel and the inclusions may appear on the surface of the stainless steel. In such a case, since corrosion may possibly proceed starting from the exposed non-metallic inclusions, it is necessary to thoroughly deoxidize the molten steel so as not to form Gd oxides.

For this purpose, it is necessary to contain Al by not less than 0.005% as an acid soluble Al (sol Al). However, if the content exceeds 0.1%, the effect is saturated and, furthermore, the hot workability is deteriorated. Accordingly, the Al content is defined as from 0.005 to 0.1%.

N: N is an element effective to stabilization of the austenitic phase in the austenitic stainless steel. For this purpose, N may sometimes be added. However, since Al is positively added in the austenitic stainless steel of the present invention, fine AlN tends to be deposited if the N content is higher. Since fine AlN deteriorates the cold workability of the steel, lower N content is more preferred. N tends to intrude into the molten steel in the steel making step and can not be removed easily. Accordingly, it is defined as not more than 0.03% as a range attainable by commercial production and not giving practically undesired effects.

Y: Y is an element effective to improve the hot workability of the austenitic stainless steel and this is an element added optionally. For obtaining this effect, it is necessary by not less than 0.005%. On the other hand, if it exceeds 0.3%, the effect is saturated. Accordingly, when Y is added, the content is preferably from 0.005 to 0.3%.

Mo: Since Mo has an effect of improving the resistance to pitting corrosion and the resistance to crevice corrosion, it is optionally added while considering the working circumstance of the austenitic stainless steel. For obtaining the effect, it is necessary to contain Mo by not less than 0.01%. On the other hand, if the content exceeds 3%, the effect is saturated, and the hot workability is deteriorated as well. Accordingly, when Mo is added, the content is preferably from 0.01 to 3%.

P and S: P and S are impurity elements intruding incidentally from raw materials used in the steel making step. Since such elements deteriorate the corrosion resistance and the workability of the austenitic stainless steel, the lower content is better. However, since there is a limit for lowering P and S in commercial production, P is defined as not more than 0.03% and S is defined as not more than 0.01% as a range with no practical disadvantage.

EXAMPLE

(Example 1)

For ferritic stainless steel, a relationship between chemical compositions and the properties of the steel was examined. Ferritic stainless steels of different chemical compositions were melted by a vacuum melting furnace and they were cast into steel ingots each of 30 kg and about 110 mm diameter.

Table 1 shows chemical compositions of the resultant steel ingots. Steel numbers No. 1–18 are ferritic stainless steel for the examples of the present invention and No. 19–28 are ferritic stainless steel of comparative examples in which the content for some of several alloying elements is out of the range specified by the present invention.

TABLE 1

| | Sample | Chemical composition (% by weight) | | | | | | | | | | | | | | | Thermal neutron absorption |
|---|---|---|---|---|---|---|---|---|---|---|---|---|---|---|---|---|---|
| | NO. | C | Si | Mn | P | S | Ni | Cr | Mo | B | Gd | Y | N | Ti | Nb | Al | ability: Nc |
| Example of the present invention | 1 | 0.002 | 0.21 | 0.31 | 0.012 | 0.012 | — | 13.4 | | 1.04 | 0.23 | | 0.002 | | | 0.023 | 2.0 |
| | 2 | 0.004 | 0.23 | 0.32 | 0.018 | 0.009 | | 15.6 | | 0.15 | 0.22 | | 0.004 | | | 0.018 | 1.1 |
| | 3 | 0.003 | 0.34 | 0.33 | 0.008 | 0.002 | | 18.4 | | 0.34 | 0.26 | | 0.006 | | | 0.009 | 1.5 |
| | 4 | 0.004 | 0.35 | 0.33 | 0.016 | 0.005 | | 18.6 | 2.5 | 0.54 | 0.12 | | 0.003 | | | 0.012 | 1.1 |
| | 5 | 0.002 | 0.25 | 0.36 | 0.019 | 0.006 | | 18.4 | 0.6 | 0.97 | 0.53 | | 0.001 | | | 0.035 | 3.3 |
| | 6 | 0.002 | 0.21 | 0.32 | 0.016 | 0.008 | | 19.1 | | 1.01 | 0.48 | | 0.003 | | | 0.036 | 3.1 |
| | 7 | 0.003 | 0.26 | 0.31 | 0.017 | 0.006 | | 18.6 | | 1.03 | 0.42 | | 0.005 | | | 0.041 | 2.9 |
| | 8 | 0.002 | 0.34 | 0.36 | 0.014 | 0.003 | | 18.5 | | 1.02 | 1.35 | 0.01 | 0.004 | | | 0.011 | 6.9 |

TABLE 1-continued

| | Sample NO. | Chemical composition (% by weight) C | Si | Mn | P | S | Ni | Cr | Mo | B | Gd | Y | N | Ti | Nb | Al | Thermal neutron absorption ability: Nc |
|---|---|---|---|---|---|---|---|---|---|---|---|---|---|---|---|---|---|
| | 9 | 0.003 | 0.33 | 0.34 | 0.016 | 0.003 | | 18.0 | | l.03 | 1.31 | 0.14 | 0.002 | | | 0.024 | 6.8 |
| | 10 | 0.004 | 0.23 | 0.39 | 0.015 | 0.002 | | 18.1 | | 1.08 | 1.32 | 0.28 | 0.005 | | | 0.031 | 6.9 |
| | 11 | 0.002 | 0.24 | 0.39 | 0.015 | 0.002 | | 18.6 | | 1.02 | 1.02 | | 0.003 | 0.31 | | 0.050 | 5.5 |
| | 12 | 0.004 | 0.26 | 0.35 | 0.014 | 0.003 | | 18.9 | | 1.05 | 1.03 | | 0.004 | 0.82 | | 0.031 | 5.6 |
| | 13 | 0.002 | 0.25 | 0.36 | 0.016 | 0.003 | | 18.6 | | 1.01 | 1.06 | | 0.003 | | 0.32 | 0.022 | 5.7 |
| | 14 | 0.002 | 0.22 | 0.39 | 0.010 | 0.002 | | 18.9 | | 1.03 | 1.03 | | 0.006 | 0.14 | 0.17 | 0.029 | 5.5 |
| | 15 | 0.003 | 0.30 | 0.30 | 0.018 | 0.002 | 0.26 | 18.1 | | 0.51 | 1.13 | | 0.002 | | | 0.007 | 5.5 |
| | 16 | 0.003 | 0.38 | 0.38 | 0.019 | 0.002 | 0.58 | 18.3 | | 0.56 | 1.11 | | 0.002 | | | 0.017 | 5.4 |
| | 17 | 0.001 | 0.36 | 0.31 | 0.009 | 0.001 | | 25.2 | | 0.56 | 0.68 | | 0.002 | | | 0.017 | 3.5 |
| | 18 | 0.002 | 0.42 | 0.38 | 0.012 | 0.005 | | 18.6 | | 1.03 | 1.30 | | 0.003 | | | 0.022 | 6.7 |
| Example | 19 | *0.025 | 0.35 | 0.39 | 0.018 | 0.003 | | 18.3 | | 1.02 | 1.13 | | 0.004 | | | 0.032 | 6.0 |
| of the | 20 | 0.005 | 0.36 | 0.34 | *0.035 | 0.006 | | 18.6 | | 0.51 | 2.39 | | 0.004 | | | 0.018 | 11.0 |
| com- | 21 | 0.003 | 0.28 | 0.36 | 0.013 | *0.027 | | 18.5 | | 1.03 | 1.24 | | 0.004 | | | 0.043 | 6.6 |
| parison | 22 | *0.012 | 0.38 | 0.41 | 0.014 | 0.005 | | 18.3 | | 1.10 | 1.51 | | *0.016 | | | 0.035 | 7.7 |
| | 23 | 0.002 | 0.33 | 0.42 | 0.015 | 0.006 | *1.89 | 18.7 | | 1.11 | 1.32 | | 0.005 | | | 0.041 | 6.9 |
| | 24 | 0.003 | 0.25 | 0.35 | 0.016 | 0.008 | | 18.2 | | 1.08 | 1.25 | | *0.034 | | | 0.023 | 6.6 |
| | 25 | 0.004 | 0.29 | 0.37 | 0.015 | 0.008 | | 18.4 | | 1.06 | *4.11 | | 0.004 | | | 0.027 | 19.1 |
| | 26 | 0.004 | 0.26 | 0.36 | 0.013 | 0.006 | | *10.4 | | 1.07 | 1.24 | | 0.006 | | | 0.016 | 6.5 |
| | 27 | 0.002 | 0.24 | 0.38 | 0.019 | 0.007 | | 18.2 | | *1.36 | 0.34 | | 0.003 | | | 0.009 | 2.8 |
| | 28 | 0.005 | 0.45 | 0.41 | 0.015 | 0.004 | *0.91 | 18.2 | | 0.53 | 1.15 | | 0.003 | | | 0.032 | 5.6 |

(Note 1)
Calculation formula for Nc; When B > 0.3%.. Nc = {(1 − 0.015 × B %) × B %} + (4.4 × Gd %)
When B ≦ 0.3%.. Nc = (B % + 4.4 × Gd %)
(Note 2) *:
Showing outside the range defined by the present invention From bottom portions of the steel ingots having the chemical compositions shown in Table 1, blocks to sample high temperature tensile test pieces for the evaluation of the hot workability by a high temperature tensile test were cut out. Subsequently, hot forging and hot rolling were applied to the steel ingots, to obtain materials each of 100 mm width and 4 mm thickness. Then, an annealing treatment was conducted to the materials under the conditions of heating the materials to 850° C. and then water cooling them. Then, Charpy impact test pieces for the evaluation of toughness, test pieces for the evaluation of the weldability and test pieces for the evaluation of the corrosion resistance for HAZ were sampled from the materials after the annealing.

The high temperature test was conducted by using rod-shaped test pieces each of 10 mm diameter and 130 mm length, under the test conditions at a temperature of 1100° C. and a tensile speed of 1/s, to determine a reduction of area for each test specimen. The hot workability was evaluated by the reduction of area (high temperature elongation).

The Charpy impact test was conducted by using sub-sized V-notched Charpy test piece of ¼ size (width) as specified in JIS Z2202, under a test condition at a temperature of 80° C.

Furthermore, the corrosion resistance was investigated for the test specimens prepared by applying bead on blade welding by TIG arc welding and sampling from HAZ. If the corrosion resistance for HAZ is satisfactory, it can be judged the corrosion resistance for the base metal is also satisfactory, so that the corrosion resistance for the base metal was omitted. The surface of the HAZ of the test piece was polished by emery paper of 600# coarseness. The corrosion test was conducted by a method of immersing the test pieces in an air saturated solution containing 2500 ppm of $B^{3+}$ and 1000 ppm of Cl— and determining a potential when a current density reached 100$\mu$ A/cm$^2$ under the conditions at a temperature of 80° C. and at a potential sweep rate of 20 mV/min. The corrosion resistance was evaluated by the test of comparing the corrosion resistance based on a pitting potential obtained by the test.

Table 2 shows the results collectively.

TABLE 2

| Sample No. | Hot workability Reduction of area at high temp. elongation test (%) | Toughness Impact value at Charpy test (J/cm$^2$) | Crrosion resistance Pitting potential for HAZ (mV vsSCE) |
|---|---|---|---|
| Example of the present invention | | | |
| 1 | 74 | 5 | 121 |
| 2 | 89 | 10 | 132 |
| 3 | 66 | 7 | 150 |
| 4 | 87 | 10 | 185 |
| 5 | 83 | 5 | 175 |
| 6 | 80 | 5 | 144 |
| 7 | 82 | 5 | 133 |
| 8 | 70 | 4 | 128 |
| 9 | 73 | 5 | 130 |
| 10 | 75 | 5 | 146 |
| 11 | 68 | 5 | 162 |
| 12 | 67 | 5 | 165 |
| 13 | 70 | 5 | 161 |
| 14 | 68 | 4 | 166 |
| 15 | 76 | 11 | 158 |
| 16 | 78 | 13 | 160 |
| 17 | 82 | 7 | 180 |
| 18 | 68 | 6 | 124 |
| Example of the comparison | | | |
| 19 | 62 | 5 | 60 |
| 20 | 42 | 11 | 81 |
| 21 | 61 | 4 | 75 |
| 22 | 66 | 3 | 34 |
| 23 | 5 | 16 | 46 |

TABLE 2-continued

| Sample No. | Hot workability Reduction of area at high temp. elongation test (%) | Toughness Impact value at Charpy test ($J/cm^2$) | Crrosion resistance Pitting potential for HAZ (mV vsSCE) |
|---|---|---|---|
| 24 | 55 | 5 | 72 |
| 25 | 8 | 3 | 136 |
| 26 | 61 | 5 | 57 |
| 27 | 48 | 3 | 126 |
| 28 | 43 | 15 | 123 |

As shown in Table 1, each of test materials in Table 1 has a sufficient thermal neutral absorption ability, having a thermal neutron absorption ability Nc of not less than 1.1. Among them, twelve test materials of steels No. 1, 5–14 and 18 for examples of the present invention are examples having the B content approximate to the upper limit defined in the present invention in which the neutron absorption ability Nc in the ferritic stainless steel is defined to a predetermined value by varying the Gd content. The Nc values for the test materials are from 2.0 to 6.9.

As shown in Table 2, for the results concerning the twelve test materials, since the B content is kept to not more than 1.1%, the reduction of area in the high temperature tensile test is as high as 67–83% and it can be seen that the hot workability is satisfactory. Furthermore, the pitting potential for HAZ is as high as 121–175 mV vs SCE, and it was recognized that they were also excellent in the corrosion resistance for HAZ.

In the examples of the present invention, steel No. 2–4 are examples having lower Gd content, and steels No. 15–17 are examples of containing the Gd amount to some extent and the lower B content of from 0.15 to 0.56%. It has been confirmed that such six test materials have the reduction of area in high temperature tensile test of from 66 to 89%, the pitting potential for HAZ of from 132 to 185 mV and are excellent both in the hot workability and the corrosion resistance for HAZ.

Furthermore, steels No. 15 and 16 containing not more than 0.7% of Ni have high toughness with the Charpy impact value being as high as from 11 to 13 $J/cm^2$. Furthermore, for steels No. 4–5 containing Mo and steels No. 11–14 containing either one or both of Ti and Nb, it has been found that the pitting potential for HAZ is high for both of them, that is from 175 to 185 mV vs SCE for the former and from 161 to 166 mV vs SCE for the latter, and the corrosion resistance for HAZ including the base metal is particularly excellent.

In steels No. 8–10 containing Y, the reduction of area in high temperature tensile test is higher compared, for example, with steels No. 11–12 for the examples of the present invention not containing Y, to show the effect of Y for improving the hot workability.

As described above, the ferritic stainless steel of the present invention have high neutron absorption ability, as well as are excellent in the hot workability, corrosion resistance and toughness and this supports the large effect of restricting the B content lower, and restricting the C content to less than 0.01% and restricting the N content to not more than 0.015%.

On the other hand, in steels No. 19–28 of comparative examples, as shown in Table 1, contents of several elements among the alloying elements are out of the range as specified in the present invention. Accordingly, as apparent from Table 2, at least one of the properties of the hot workability and the corrosion resistance is poor. Particularly, steel No. 27 having the B content exceeding the range defined by the present invention have lower reduction of area of 48% in high temperature tensile test of 48% and lower Charpy impact value of 3 $J/cm^2$, and it is apparent that both of the hot workability and the toughness are poor. Since the B content is excessively high as 1.36%, the undesired effect thereof appears distinctly.

Furthermore, steels No. 19, 22 and 24 with one or both of the contents for C and N being outside of the range specified by the present invention have the pitting potential of from 34 to 72 mV vs SCE, each of which is lower compared with the examples of the present invention and it is apparent that they are poor in the corrosion resistance. Steels No. 23 and 25 having excessively high Gd and Ni contents have extremely low reduction of area in high temperature tensile test, which supports that the hot workability is extremely poor.

As described above, in the comparative examples in which the contents for some of the alloying elements are out of the range specified by the present invention could not provide ferritic stainless steel having high neutron absorbing ability aimed at in the present invention, as well as excellent hot workability, corrosion resistance and toughness.

While examples were not shown for the cold workability, no cracking was caused as a result of conducting a bending test at a bending radius twice the plate thickness for the ferritic stainless steel in the examples of the present invention. From the result, it has been confirmed that the ferritic stainless steel of the present invention are excellent also in the cold workability.

(Example 2)

For austenitic stainless steel, a relationship between chemical compositions and the properties of steel was examined. Austenitic stainless steel of different chemical compositions were melted by a vacuum melting furnace and they were cast into steel ingots each of 30 kg and about 110 mm diameter.

Table 3 shows chemical compositions of the resultant steel ingots. Steels No. 1–12 are austenitic stainless steel for examples of the present invention and steels No. 13–24 are austenitic stainless steel of comparative examples having contents for several alloying elements outside of the range specified by the present invention.

TABLE 3

| | Sample | Chemical composition (% by weight) | | | | | | | | | | | | | Thermal neutron absorption |
|---|---|---|---|---|---|---|---|---|---|---|---|---|---|---|---|
| | No. | C | Si | Mn | P | S | Ni | Cr | Mo | B | Gd | Y | N | Al | ability: Nc |
| Example of the present invention | 1 | 0.015 | 0.26 | 0.86 | 0.015 | 0.001 | 9.8 | 18.2 | — | 0.05 | 0.23 | — | 0.016 | 0.035 | 1.1 |
| | 2 | 0.013 | 0.24 | 0.74 | 0.017 | 0.005 | 10.3 | 18.4 | — | 0.11 | 1.03 | — | 0.014 | 0.007 | 4.6 |
| | 3 | 0.014 | 0.26 | 0.84 | 0.015 | 0.005 | 20.6 | 24.5 | 0.05 | 0.16 | 0.35 | 0.174 | 0.006 | 0.054 | 1.7 |
| | 4 | 0.012 | 0.23 | 0.78 | 0.014 | 0.004 | 10.4 | 19.5 | — | 0.18 | 1.48 | — | 0.014 | 0.039 | 6.7 |

TABLE 3-continued

| | Sample No. | Chemical composition (% by weight) C | Si | Mn | P | S | Ni | Cr | Mo | B | Gd | Y | N | Al | Thermal neutron absorption ability: Nc |
|---|---|---|---|---|---|---|---|---|---|---|---|---|---|---|---|
| | 5 | 0.018 | 0.27 | 0.68 | 0.017 | 0.004 | 21.2 | 26.8 | — | 0.24 | 0.54 | 0.026 | 0.008 | 0.051 | 2.6 |
| | 6 | 0.010 | 0.27 | 0.62 | 0.015 | 0.002 | 9.5 | 19.4 | — | 0.28 | 0.45 | 0.017 | 0.019 | 0.092 | 2.3 |
| | 7 | 0.014 | 0.32 | 0.85 | 0.018 | 0.003 | 8.7 | 18.6 | — | 0.30 | 0.12 | 0.261 | 0.028 | 0.037 | 0.8 |
| | 8 | 0.013 | 0.21 | 0.29 | 0.016 | 0.002 | 18.5 | 22.4 | 2.8 | 0.38 | 0.41 | 0.025 | 0.007 | 0.068 | 2.2 |
| | 9 | 0.016 | 0.28 | 0.70 | 0.015 | 0.005 | 9.6 | 18.6 | — | 0.45 | 0.24 | 0.015 | 0.013 | 0.021 | 1.5 |
| | 10 | 0.017 | 0.72 | 0.62 | 0.026 | 0.002 | 10.8 | 20.4 | — | 0.70 | 1.20 | — | 0.018 | 0.015 | 6.0 |
| | 11 | 0.019 | 0.68 | 0.89 | 0.021 | 0.003 | 10.3 | 19.3 | — | 0.66 | 0.20 | 0.028 | 0.029 | 0.018 | 1.5 |
| | 12 | 0.014 | 0.82 | 0.78 | 0.024 | 0.002 | 10.1 | 18.2 | 0.8 | 0.74 | 0.25 | — | 0.021 | 0.028 | 1.8 |
| Example of the comparison | 13 | 0.016 | 0.35 | 0.69 | 0.013 | 0.001 | 9.4 | 18.7 | — | *0.84 | *0.09 | — | 0.012 | 0.026 | 1.2 |
| | 14 | 0.017 | 0.67 | 0.78 | 0.022 | 0.004 | 9.2 | 18.5 | — | *1.24 | 0.35 | — | 0.028 | 0.038 | 2.8 |
| | 15 | 0.015 | 0.27 | 0.88 | 0.015 | 0.004 | 9.7 | 19.2 | — | *0.82 | *2.11 | — | 0.015 | 0.028 | 10.1 |
| | 16 | 0.018 | 0.21 | 0.85 | 0.014 | 0.005 | 10.2 | 19.0 | — | 0.14 | *2.09 | 0.026 | *0.050 | 0.036 | 9.3 |
| | 17 | 0.016 | 0.69 | 0.77 | 0.023 | 0.003 | 9.7 | 18.9 | — | 0.35 | * — | — | 0.028 | 0.029 | 0.3 |
| | 18 | 0.016 | 0.55 | 0.81 | 0.025 | 0.003 | 10.7 | 19.2 | — | 0.68 | * — | — | 0.024 | 0.041 | 0.7 |
| | 19 | 0.014 | 0.63 | 0.92 | 0.027 | 0.004 | 10.8 | 19.5 | — | *1.55 | * — | — | 0.026 | 0.055 | 1.5 |
| | 20 | 0.019 | 0.23 | 0.85 | 0.016 | 0.002 | 10.1 | 18.2 | *4.2 | 0.11 | 0.32 | — | 0.016 | 0.033 | 1.5 |
| | 21 | 0.014 | 0.24 | 0.81 | 0.017 | 0.002 | 8.6 | *16.5 | — | 0.16 | 0.30 | — | 0.014 | 0.016 | 1.5 |
| | 22 | *0.027 | 0.29 | 0.79 | 0.012 | 0.003 | 8.2 | 18.6 | — | 0.17 | 0.33 | — | 0.013 | 0.018 | 1.6 |
| | 23 | 0.012 | 0.45 | 1.17* | 0.021 | 0.002 | 10.2 | 18.2 | — | 0.45 | 0.28 | — | 0.018 | 0.028 | 1.7 |
| | 24 | 0.017 | 0.47 | 1.45* | 0.017 | 0.001 | 10.8 | 18.1 | — | 0.21 | 0.21 | — | 0.021 | 0.026 | 1.1 |

(Note 1)
Calculation formula for Nc; When B > 0.3%.. Nc = {(1 − 0.015 × B %) × B %} + (4.4 × Gd %)
When B ≦ 0.3%.. Nc = (B % + 4.4 × Gd %)
(Note 2) *:
Showing outside the range defined by the present invention From bottom portions of the steel ingots having the chemical compositions shown in Table 3, blocks to sample high temperature tensile test pieces for the evaluation of the hot workability were cut out. Subsequently, hot forging and hot rolling were applied to the steel ingots, to obtain materials each of 100 mm width and 4 mm thickness. Then, an solution heat treatment was conducted to the materials under the conditions of heating the materials to 1050° C. and then water cooling them. Then, test pieces for the evaluation of the weldability and test pieces for the evaluation of the corrosion resistance for HAZ were sampled from the materials after the solid solution heat treatment.

The high temperature tensile test was conducted by using a rod-shaped test pieces each of 10 mm diameter and 130 mm length, under the test conditions at a temperature of 1050° C. and a tensile speed of 1/s, to determine a reduction of area for each test specimen. The hot workability was evaluated by the reduction of area (high temperature elongation).

The weldability was evaluated by cutting out test specimens each of 100 width and 100 length from the materials, applying TIG arc welding to the test pieces under the condition at a voltage of 15 V, a current of 200 A and a velocity of 150 m/min and measuring cracks in the welded zones. The cracks in the welded zones were investigated by a method of applying a Varestrain test at 2% distortion, conducting a penetration flaw detection test, observing cracked portion with a stereo-microscope and determining the length of cracks developed.

Furthermore, the corrosion resistance was investigated for the test specimens prepared by subjecting the material after the solution heat treatment to a sensitizing treatment of further keeping at 650° C. for 2 hours, applying bead on blade welding by TIG arc welding and sampling test specimens from HAZ. If the corrosion resistance for HAZ is satisfactory, it can be judged that the corrosion resistance for the base metal is also satisfactory, so that the corrosion resistance for the base metal was omitted. The surface of the HAZ of the test piece was polished by emery paper of 600# coarseness. The corrosion test was conducted by a method of immersing test pieces in an air saturated solution containing 3000 ppm of $B^{3+}$ and 500 ppm of Cl— and determining a potential when a current density reached 100$\mu$ A/cm$^2$ under the conditions at a temperature of 80° C. and at a potential sweep rate of 20 mV/min. The corrosion resistance was evaluated by a method of comparing the corrosion resistance based on the pitting potential obtained by the test.

The cold workability was evaluated by the method of subjecting a plate-like test pieces each of 20 mm width, 3 mm thickness and 100 mm length to 180° bending at a radius of 6 mm and 3 mm in a cold state, observing bent portions with naked eyes and investigating the absence or presence of cracks.

Table 4 shows the results collectively.

TABLE 4

| Sample No. | Hot workability Reduction of area at high temp. elongation test (%) | Weldability Crack length in Varestrain test (mm) | Cold Workability Bending radius 6 mm | 3 mm | Corrosion resistance Pitting potential for HAZ (mV vsSCE) |
|---|---|---|---|---|---|
| Example of the present invention | | | | | |
| 1 | 89 | 0.2 | ○ | ○ | 91 |
| 2 | 74 | 0.3 | ○ | ○ | 92 |
| 3 | 86 | 0.3 | ○ | ○ | 102 |
| 4 | 72 | 0.6 | ○ | ○ | 90 |
| 5 | 72 | 0.4 | ○ | ○ | 105 |
| 6 | 77 | 1.5 | ○ | ○ | 87 |
| 7 | 88 | 0.8 | ○ | x | 94 |
| 8 | 72 | 0.6 | ○ | x | 109 |
| 9 | 78 | 6.4 | ○ | x | 78 |
| 10 | 73 | 4.1 | ○ | x | 71 |

TABLE 4-continued

| Sample No. | Hot workability Reduction of area at high temp. elongation test (%) | Weldability Crack length in Varestrain test (mm) | Cold Workability Bending radius 6 mm | Cold Workability Bending radius 3 mm | Corrosion resistance Pitting potential for HAZ (mV vsSCE) |
|---|---|---|---|---|---|
| 11 | 72 | 4.3 | ○ | x | 66 |
| 12 | 75 | 1.5 | ○ | x | 74 |
| Example of the comparison | | | | | |
| 13 | 67 | 4.2 | x | x | 63 |
| 14 | 58 | 2.1 | x | x | −16 |
| 15 | 30 | 4.1 | x | x | 70 |
| 16 | 36 | 0.9 | ○ | ○ | 86 |
| 17 | 76 | 16.8 | ○ | x | 71 |
| 18 | 72 | 14.2 | ○ | x | 61 |
| 19 | 54 | 1.8 | x | x | −26 |
| 20 | 53 | 0.8 | ○ | ○ | 125 |
| 21 | 86 | 0.7 | ○ | ○ | −21 |
| 22 | 84 | 0.6 | ○ | ○ | −36 |
| 23 | 72 | 7.8 | ○ | x | −12 |
| 24 | 78 | 9.6 | ○ | x | −25 |

As shown in Table 3, each of test materials for examples of the present invention has a sufficient thermal neutral absorption ability, having a thermal neutron absorption ability Nc of not more than 1.1. Among them, three test materials of steels No. 10–12 for examples of the present invention are examples having the B content approximate to the upper limit defined in the present invention in which the neutron absorption ability Nc in the austenitic stainless steel is defined to a predetermined value by varying the Gd content. The Nc values for the test materials are as high as 1.5 to 6.0.

As shown in Table 4, for the results concerning the three test materials, since the B content is kept to not more than 0.75%, the reduction of area in the high temperature tensile test is as high as 72–75% and it can be seen that the hot workability is satisfactory. The weldability is also satisfactory, since the length of cracks is not more than 6.4 mm. Furthermore, the pitting potential for the test specimens samples from HAZ of the sensitized base metal is as high as 66–74 mV vs SCE, and it has been recognized that they are also excellent in the corrosion resistance for the base metal and the HAZ. Since each of steels No. 1–9 for other examples of the present invention has the B-content of not more than 0.5%, which is lower than that of the three test materials, properties such as hot workability, weldability, cold workability (bendability) and the like are further satisfactory.

In each of the test materials for steels No. 1–12 for the examples of the present invention, the Mn content is lower as not more than 0.9%. Accordingly, the pit potential for HAZ is as high as not less than 71 mV vs SCE and the corrosion resistance for HAZ is particularly satisfactory. They are of course excellent in the corrosion resistance of the base metal.

As described above, the austenitic stainless steel of the present invention have high neutron absorption ability, as well as are excellent in the hot workability, weldability, cold workability and corrosion resistance. This is because the B content is restricted lower as 0.75% and, in addition, Gd is contained by a required minimum amount and, furthermore, Mn is restricted to not more than 0.9%.

On the other hand, in steels No. 13–24 of comparative examples, contents for several elements among the alloying elements are out of the range specified in the present invention as shown in Table 3. Accordingly, as apparent from Table 4, at least one of the properties of the hot workability, the weldability, the cold workability and the corrosion resistance is poor. Particularly, four test materials of steels No. 13–15 and 19 having the B content exceeding the range specified by the present invention have a reduction of area in a high temperature tensile test of not more than 67% and they are poor in the hot workability, weldability and extremely deteriorated in bending, that is, the cold workability.

Furthermore, test materials of steels No. 23 and 24 in which the Mn content exceeds the range specified by the present invention have extremely low pitting potential and it is apparent that they are poor in the corrosion resistance for HAZ as well as the base metal. Furthermore, steels No. 15 and 16 having excessively high Gd content have extremely low reduction of area in the high temperature tensile test and were poor in the hot workability.

Steel No. 18 is an example in which the thermal neutron absorption ability Nc is 0.7 and can not satisfy a preferred aimed value of 0.8 since Gd is not contained although the B content is increased near the upper limit. It can be seen that the use of Gd is necessary if the Nc value can not be satisfied with B alone.

The steels No. 17 and 18 are examples in which other elements than Gd are within the range specified by the present invention and in which Gd is not contained. In this case, cracking is remarkable and the weldability was poor as apparent from the results for the weldability in Table 4. It has been confirmed that the combined use of B and a small amount of Gd is effective also in view of the weldability.

As described above, in the comparative examples in which contents for some of the alloying elements are out of the range specified by the present invention could not provide austenitic stainless steel having high neutron absorbing ability aimed at in the present invention, as well as excellent hot workability, cold workability and corrosion resistance.

Industrial Applicability

In the ferritic and austenitic stainless steel according to the present invention, the B content is restricted low in view of the hot workability, the weldability and the like, the content is selected as high as possible within the specified range and insufficiency of the thermal neutron absorption ability is compensated with Gd. Accordingly, the stainless steel of the present invention have sufficient thermal neutron absorption ability, are excellent in the properties such as hot workability, weldability and cold workability and also inexpensive for the manufacturing cost.

Furthermore, since Mn is restricted low in the ferritic stainless steel while C and N contents are restricted low in the austenitic stainless steel, they are also excellent in the corrosion resistance for the base metal and the weld heat affected zone (HAZ).

Therefore, they are materials most suitable to application uses for nuclear fuel transportation casks, spent nuclear fuel storage casks or racks in nuclear industries for which excellent corrosion resistance as well as high thermal neutron absorption ability are required.

What is claimed is:

1. Ferritic stainless steel having excellent thermal neutron absorption ability, comprising of the following chemical composition on the weight % basis:

| | |
|---|---|
| C: lesss than 0.01% | Si: not more than 0.5% |
| Mn: not more than 1% | P: not more than 0.03% |
| S: not more than 0.01% | Ni: not more than 0.7% |
| Cr: 13–26% | B: 0.1–1.1% |
| Gd: 0.05–1.5% | Al: 0.002–0.1% |
| N: not more than 0.015% | Ti: not more than 1% |
| Nb: not more than 1% | Y: not more than 0.3 |
| Mo: not more than 3% | |
| Balance: incidental impurities and Fe. | |

2. Ferritic stainless steel, comprising of the chemical composition as defined in claim 1, in which satisfies the following equation (1):

$$Nc \geqq 0.8 \quad (1)$$

in which $$Nc=\{(1-0.015\times B\ \%)\times B\ \%\}+(4.4\times Gd\ \%).$$

3. Ferritic stainless steel as defined in claim 1,,wherein the C and N contents are:

| | |
|---|---|
| C: not more than 0.005% | N: not more than 0.008%. |

4. Ferritic stainless steel as defined in claim 2, wherein the C and N contents are:

| | |
|---|---|
| C: not more than 0.005% | N: not more than 0.008%. |

5. Ferritic stainless steel as defined in claim 1, wherein the Ni content is 0.05 to 0.7%.

6. Ferritic stainless steel as defined in claim 2, wherein the Ni content is 0.05 to 0.7%.

7. Ferritic stainless steel as defined in claim 1, wherein the C, N and Ni contents are:

| | |
|---|---|
| C: not more than 0.005% | N: not more than 0.008% |
| Ni: 0.05 to 0.7%. | |

8. Ferritic stainless steel as defined in claim 2, wherein the C, N and Ni contents are:

| | |
|---|---|
| C: not more than 0.005% | N: not more than 0.0008% |
| Ni: 0.05 to 0.7%. | |

9. Austenitic stainless steel having excellent thermal neutron absorption ability, comprising of the following chemical composition on the weight % basis:

| | |
|---|---|
| C: not more than 0.02% | Si: not more than 1% |
| Mn: 0.1–0.9% | P: not more than 0.03% |
| S: not more than 0.01% | Ni: 7–22% |
| Cr: 18–26% | B: 0.05–0.75% |
| Gd: 0.11–1.5% | Al: 0.005–0.1% |
| N: not more than 0.030% | Y: not more than 0.3 |
| Mo: not more than 3% | |
| Balance: incidental impurities and Fe. | |

10. Austenitic stainless steel, comprising of the chemical composition as defined in claim 9, in which satisfies the following equation (1):

$$Nc \geqq 0.8 \quad (1)$$

in which $$Nc=\{(1-0.015\times B\ \%)\times B\ \%\}+(4.4\times Gd\ \%).$$

11. Austenitic stainless steel as defined in claim 9, wherein the B content is 0.2 to 0.75%.

12. Austenitic stainless steel as defined in claim 10, wherein the B content is 0.2 to 0.75%.

13. Austenitic stainless steel as defined in claim 9, wherein the B content is 0.2 to 0.5%.

14. Austenitic stainless steel as defined in claim 10, wherein the B content is 0.2 to 0.5%.

15. Austenitic stainless steel as defined in claim 9, wherein Mo and Y contents are:

| | |
|---|---|
| Mo: 0.01–3% | Y: 0.005–0.3%. |

16. Austenitic stainless steel as defined in claim 10, wherein Mo and Y contents are:

| | |
|---|---|
| Mo: 0.01–3% | Y: 0.005–0.3%. |

17. Austenitic stainless steel as defined in claim 9, wherein B, Mo and Y contents are:

| | |
|---|---|
| B: 0.2–0.75% | Mo: 0.01–3% |
| Y: 0.005–0.3%. | |

18. Austenitic stainless steel as defined in claim 10, wherein B, Mo and Y contents are:

| | |
|---|---|
| B: 0.2–0.75% | Mo: 0.01–3% |
| Y: 0.005–0.3%. | |

19. Austenitic stainless steel as defined in claim 9, wherein B, Mo and Y contents are:

| | |
|---|---|
| B: 0.2–0.5% | Mo: 0.01–3% |
| Y: 0.005–0.3%. | |

20. Austenitic stainless steel as defined in claim 10, wherein B, Mo and Y contents are:

| | |
|---|---|
| B: 0.2–0.5% | Mo: 0.01–3% |
| Y: 0.005–0.3%. | |

* * * * *